US009316941B2

(12) United States Patent
Amano et al.

(10) Patent No.: US 9,316,941 B2
(45) Date of Patent: Apr. 19, 2016

(54) DEVELOPING DEVICE, IMAGE FORMING APPARATUS

(71) Applicant: KYOCERA Document Solutions Inc., Osaka-shi, Osaka (JP)

(72) Inventors: Takeshi Amano, Osaka (JP); Akihiro Watanabe, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/799,530

(22) Filed: Jul. 14, 2015

(65) Prior Publication Data

US 2016/0018757 A1 Jan. 21, 2016

(30) Foreign Application Priority Data

Jul. 17, 2014 (JP) ..... 2014-146419
Jul. 17, 2014 (JP) ..... 2014-146420

(51) Int. Cl.
*G03G 15/08* (2006.01)

(52) U.S. Cl.
CPC ..... *G03G 15/0822* (2013.01); *G03G 15/0891* (2013.01)

(58) Field of Classification Search
CPC ..... G03G 15/0808
See application file for complete search history.

(56) References Cited

FOREIGN PATENT DOCUMENTS

JP 2008129357 A 6/2008
JP 2012093614 A * 5/2012

OTHER PUBLICATIONS

JP_2012093614_A_T Machine Translation, Japan, May 2012, Kayahara.*

* cited by examiner

*Primary Examiner* — Clayton E Laballe
*Assistant Examiner* — Victor Verbitsky
(74) *Attorney, Agent, or Firm* — Alleman Hall McCoy Russell & Tuttle LLP

(57) ABSTRACT

A development execution control portion executes a development process by causing an intermediate lateral conveyance portion and a developing portion to operate. A developer replenishment control portion causes a developer replenishment portion to operate when a detection result of a developer amount sensor satisfies a predetermined shortage condition. A post-development processing control portion causes the intermediate lateral conveyance portion and the developing portion to operate continuously from and after a development process and then stop.

2 Claims, 8 Drawing Sheets

DEVELOPING DEVICE, IMAGE FORMING APPARATUS

INCORPORATION BY REFERENCE

This application is based upon and claims the benefit of priority from the corresponding Japanese Patent Application No. 2014-146419 filed on Jul. 17, 2014, and No. 2014-146420 filed on Jul. 17, 2014, the entire contents of which are incorporated herein by reference.

BACKGROUND

The present disclosure relates to an electrophotographic developing device and an image forming apparatus including the developing device.

In general, an electrophotographic image forming apparatus includes an image carrier and a developing device. The developing device is known to include a developing portion and a developer replenishment portion, wherein the developing portion develops an electrostatic latent image on the image carrier, and the developer replenishment portion replenishes developer to the developing portion.

The developing portion develops the electrostatic latent image on the image carrier by supplying the developer from a developing tank to the image carrier. The developer replenishment portion starts to operate when the amount of developer in the developing tank is reduced.

In some cases, the developing device further includes an intermediate lateral conveyance portion when a developer outlet of the developer replenishment portion and a developer inlet of the developing portion are located at different positions in the horizontal direction. The intermediate lateral conveyance portion conveys the developer sent out from the outlet of the developer replenishment portion, toward the inlet of the developing portion along a lateral conveyance path that extends in the lateral direction.

With the operation of the developer replenishment portion and the intermediate lateral conveyance portion, the developer is replenished from the developer replenishment portion to the developing portion via the intermediate lateral conveyance portion.

SUMMARY

A developing device according to an aspect of the present disclosure includes a developer replenishment portion, an intermediate lateral conveyance portion, a developing portion, a developer amount sensor, a development execution control portion, a developer replenishment control portion, and a post-development processing control portion. The developer replenishment portion is configured to deliver developer from a replenishment container storing the developer. The intermediate lateral conveyance portion is configured to convey the developer delivered from the developer replenishment portion to an outlet of a lateral conveyance path along the lateral conveyance path that extends in a lateral direction. The developing portion is configured to develop an electrostatic latent image on an image carrier by supplying, to the image carrier, the developer from a developing tank that stores the developer sent out from the outlet of the lateral conveyance path. The developer amount sensor is configured to detect an amount of the developer in the developing tank. The development execution control portion is configured to execute a development process by causing the intermediate lateral conveyance portion and the developing portion to operate. The developer replenishment control portion is configured to cause the developer replenishment portion to operate when a detection result of the developer amount sensor satisfies a predetermined shortage condition. The post-development processing control portion is configured to cause the intermediate lateral conveyance portion and the developing portion to operate continuously from and after the development process and then stop.

A developing device according to another aspect of the present disclosure includes a developer replenishment portion, an intermediate lateral conveyance portion, a developing portion, a developer amount sensor, a development execution control portion, a developer replenishment control portion, and a development resumption pre-processing control portion. The developer replenishment portion is configured to deliver developer from a replenishment container storing the developer. The intermediate lateral conveyance portion is configured to convey the developer delivered from the developer replenishment portion to an outlet of a lateral conveyance path along the lateral conveyance path that extends in a lateral direction. The developing portion includes a circulating conveyance portion and a developing roller. The circulating conveyance portion is configured to cause the developer to circulate in a developing tank storing the developer sent out from the outlet of the lateral conveyance path. The developing roller is configured to supply the developer from the developing tank to an image carrier. The developer amount sensor is configured to detect an amount of the developer in the developing tank. The development execution control portion is configured to execute a development process of developing an electrostatic latent image on the image carrier, by causing the circulating conveyance portion and the developing roller to operate. The developer replenishment control portion is configured to execute a developer replenishment process by causing the developer replenishment portion and the intermediate lateral conveyance portion to operate when a detection result of the developer amount sensor satisfies a predetermined shortage condition while the development process is executed. The development resumption pre-processing control portion is configured to cause the intermediate lateral conveyance portion and the circulating conveyance portion to operate before the development process and the developer replenishment process resume from a suspension.

An image forming apparatus according to a further aspect of the present disclosure includes an image carrier and the developing device according to the aspect of the present disclosure.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following description is an example of a specific embodiment of the present disclosure and should not limit the technical scope of the disclosure.

[Configuration of Image Forming Apparatus 10]

Figure 1:
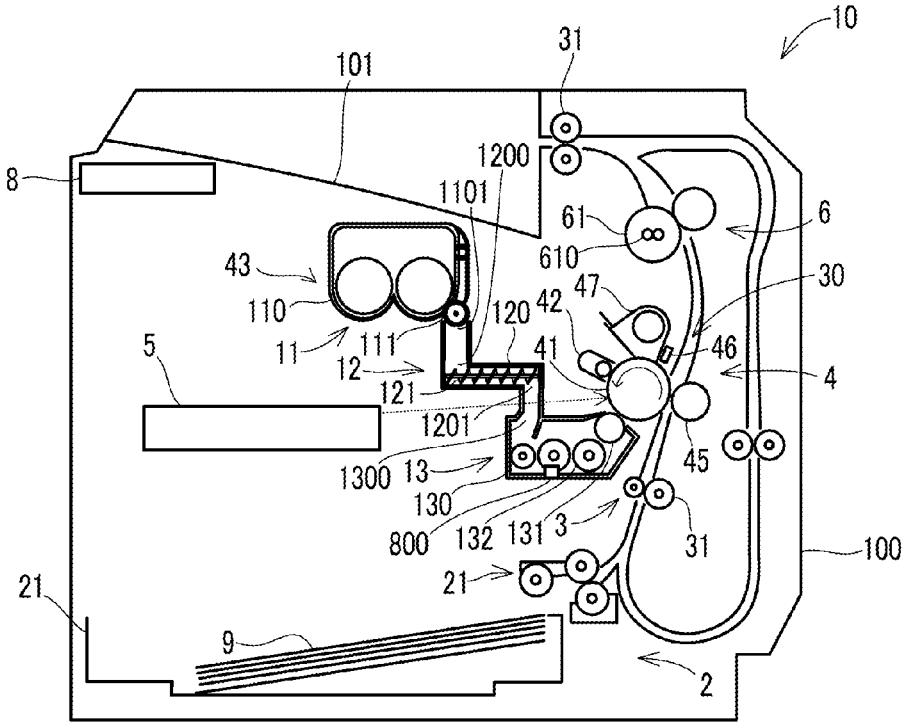
FIG. 1 is a configuration diagram of an image forming apparatus including a developing device according to the first embodiment of the present disclosure.

First, configurations of a developing device 43 according to the first embodiment of the present disclosure and an image forming apparatus 10 including the developing device 43 are described with reference to FIGS. 1 and 2. The image forming apparatus 10 is an electrophotographic image forming apparatus. As shown in FIG. 1, the image forming apparatus 10 includes, in a housing 100, a sheet supply portion 2, a sheet conveyance portion 3, an image forming portion 4, an optical scanning portion 5, a fixing portion 6, a developer amount sensor 800, and a control portion 8.

It is noted that the image forming apparatus 10 is, for example, a printer, a copier, a facsimile or a multifunction peripheral. The multifunction peripheral has functions of the printer, the copier and the like.

The sheet supply portion 2 includes a sheet receiving portion 21 and a sheet feed portion 22. The sheet receiving portion 21 is configured to have a plurality of recording sheets 9 stacked therein. It is noted that the recording sheet 9 is a sheet-like image forming medium such as a sheet of paper, a sheet of coated paper, a postcard, an envelope, or an OHP sheet.

The sheet feed portion 22 is configured to feed a recording sheet 9 from the sheet receiving portion 21 to a conveyance path 30, by rotating while in contact with the recording sheet 9.

The sheet conveyance portion 3 includes a conveyance roller 31. The conveyance roller 31 conveys the recording sheet 9 that is supplied from the sheet supply portion 2, toward the image forming portion 4 and discharges the recording sheet 9 on which an image has been formed, onto a discharge tray 101 from a discharge port of the conveyance path 30.

The image forming portion 4 forms an image on the recording sheet 9 that was supplied from the sheet feed portion 22 and is moving in the conveyance path 30. The image forming portion 4 includes a drum-like photoconductor 41, a charging device 42, a developing device 43, a transfer device 45, an electricity removing device 46, and a cleaning device 47. It is noted that the photoconductor 41 is an example of the image carrier.

The photoconductor 41 rotates, and the charging device 42 uniformly charges the surface of the photoconductor 41. In addition, the optical scanning portion 5 writes an electrostatic latent image on the charged surface of the photoconductor 41, by scanning a laser beam thereon.

In addition, the developing device 43 develops the electrostatic latent image on the photoconductor 41 by the developer. Furthermore, the transfer device 45 transfers the image (the image formed by the developer) on the surface of the photoconductor 41 to the recording sheet 9 that is moving in the conveyance path 30. The developer is, for example, a one-component developer composed of toner, or a two-component developer that is composed of toner and carrier.

The electricity removing device 46 removes electricity from the surface of the photoconductor 41 after the transfer of the image, and the cleaning device 47 removes remnant developer from the surface of the photoconductor 41.

The fixing portion 6 nips the recording sheet 9 with an image formed thereon, between a fixing roller 61, in which is embedded a heater 610 such as a halogen heater, and a pressure roller 62 and feeds the sheet to a downstream step. In this operation, the fixing portion 6 heats the image of the developer on the recording sheet 9 and fixes the image to the recording sheet 9.

[Details of Developing Device]

The developing device 43 includes a developer replenishment portion 11, a developer intermediate conveyance portion 12, and a developing portion 13. It is noted that in the present embodiment, the developing device 43 includes a portion of the control portion 8 that controls the developer replenishment portion 11, the developer intermediate conveyance portion 12 and the developing portion 13.

As shown in FIG. 1, the developing portion 13 includes a developing tank 130, a developing roller 131, and a circulating conveyance portion 132. The developing tank 130 is a container for storing the developer supplied from the developer replenishment portion 11 via the developer intermediate conveyance portion 12.

The developing portion 13 develops the electrostatic latent image on the photoconductor 41 by supplying the developer in the developing tank 130 to the photoconductor 41. The circulating conveyance portion 132 rotates in the developing tank 130 so as to convey the developer to a peripheral of the developing roller 131 while circulating the developer in the developing tank 130. The circulating conveyance portion 132 is also a stirring portion that stirs the developer in the developing tank 130. The circulating conveyance portion 132 includes, for example, a plurality of screw-type conveyance members which are each a rotator that includes a rotation shaft portion and a blade portion helically formed around the rotation shaft portion.

When an image forming job is executed, the developing roller 131 supplies the developer to the surface of the photoconductor 41 so as to develop the electrostatic latent image on the surface of the photoconductor 41 by the developer. It is noted that the developing roller 131 may also be referred to as a developing sleeve.

The developer replenishment portion 11 is attached to the main body portion (inside the housing 100) of the image forming apparatus 10 in a detachable manner, wherein the main body portion includes the developing portion 13.

The developer replenishment portion 11 includes a replenishment container 110 and a developer delivering portion 111. The replenishment container 110 is a container storing the developer. The developer delivering portion 111 rotates so as to deliver the developer from the replenishment container 110 to the developer intermediate conveyance portion 12.

The developer delivering portion 111 is, for example, a screw-type conveyance member that is a rotator that includes a rotation shaft portion and a blade portion helically formed around the rotation shaft portion.

The developer intermediate conveyance portion 12 includes an intermediate lateral conveyance portion 121. The intermediate lateral conveyance portion 121 conveys the developer delivered from the developer replenishment portion 11 to an outlet 1201 of a lateral conveyance path 120 along the lateral conveyance path 120 that extends in a lateral direction. An inlet 1200 of the lateral conveyance path 120 is vertically communicated with an outlet 1101 of the developer replenishment portion 11. Similarly, the outlet 1201 of the lateral conveyance path 120 is vertically communicated with an inlet 1300 of the developing portion 13.

It is noted that the outlet 1101 of the developer replenishment portion 11 is a developer outlet of the replenishment container 110. The inlet 1300 of the developing portion 13 is a developer inlet of the developing tank 130.

The lateral conveyance path 120 is formed in a cylindrical member that is supported in a state where its center line extends along the lateral direction. It is noted that the lateral direction includes a horizontal direction (right sideways) and such directions that are slightly inclined with respect to the horizontal direction, for example, a direction (a diagonally horizontal direction) that forms an acute angle less than 45 degrees to the horizontal direction.

The intermediate lateral conveyance portion 121 rotates in the lateral conveyance path 120 so as to convey the developer in the lateral direction. The intermediate lateral conveyance portion 121 conveys the developer from the inlet 1200 side of the lateral conveyance path 120 toward the outlet 1201. That is, the developer replenishment portion 11 replenishes the developer from the replenishment container 110 to the developing tank 130 via the intermediate lateral conveyance portion 121.

The intermediate lateral conveyance portion 121 may be, for example, a screw-type conveyance member that is a rotator that includes a rotation shaft portion and a blade portion helically formed around the rotation shaft portion.

The photoconductor 41, the developing roller 131, the circulating conveyance portion 132, and the intermediate lateral conveyance portion 121 are rotationally driven by a development drive portion 14. The development drive portion 14 includes, for example, a gear mechanism that transmits a rotational force of a motor to the rotators: the photoconductor 41, the developing roller 131, the circulating conveyance portion 132, and the intermediate lateral conveyance portion 121.

The developer delivering portion 111 of the developer replenishment portion 11 is driven by a replenishment drive portion 15. The replenishment drive portion 15 includes, for example, a gear mechanism and a clutch, wherein the gear mechanism transmits the rotational force of a driving source (motor) of the development drive portion 14 to the developer delivering portion 111, and the clutch can release a connection between the gear mechanism and the driving source.

The developer amount sensor 800 is a sensor for detecting the size of the amount of developer in the developing tank 130. The developer amount sensor 800 may be, for example, a permeability sensor that detects magnetism that varies in response to the amount of the developer in the developing tank 130. As another example, the developer amount sensor 800 may be a piezoelectric vibration type sensor that outputs a signal that varies depending on the amount of the developer (powder) present in the vicinity of the sensor. As a still another example, the developer amount sensor 800 may be a transmission type optical sensor.

The control portion 8 controls various types of equipment provided in the image forming apparatus 10. The control portion 8 controls, for example, the development drive portion 14 and the replenishment drive portion 15 based on the detection result of the developer amount sensor 800. In the present embodiment, at least a portion of the control portion 8 that controls the development drive portion 14 and the replenishment drive portion 15 forms a part of the developing device 43.

Figure 2:
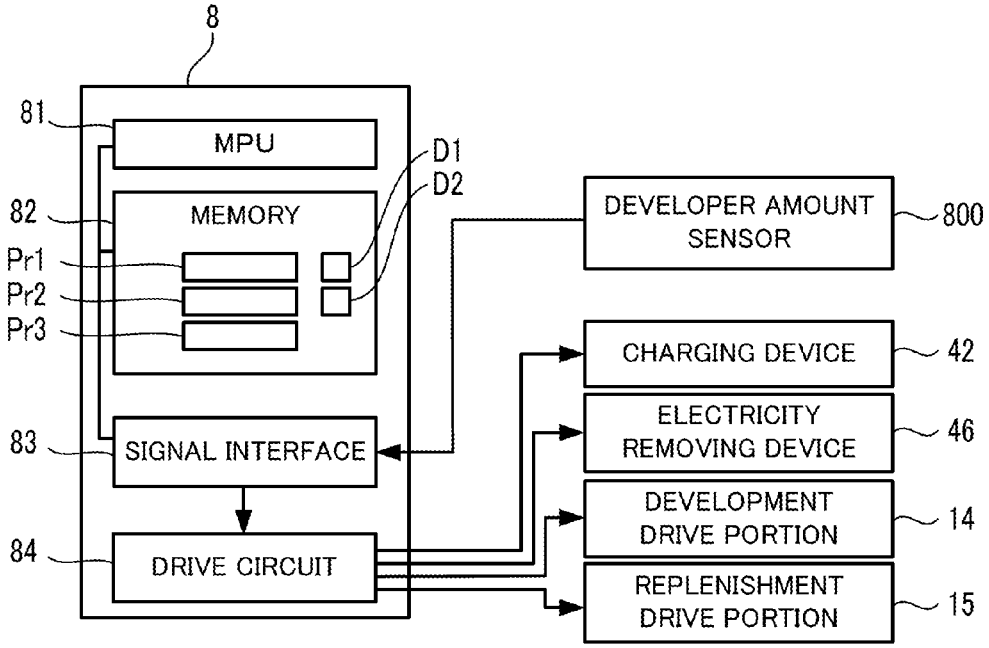
FIG. 2 is a block diagram of control-related equipment of the developing device according to the first embodiment of the present disclosure.

As shown in FIG. 2, the control portion 8 includes an MPU (Micro Processor Unit) 81, a memory 82, a signal interface 83, and a drive circuit 84.

The MPU 81 is a processor for executing various types of arithmetic processes. The control portion 8 comprehensively controls the image forming apparatus 10 when the MPU 81 executes various types of control programs Pr1, Pr2, Pr3 stored in advance in the memory 82.

The memory 82 is a nonvolatile storage portion in which various pieces of information such as the control programs Pr1, Pr2, Pr3 that cause the MPU 81 to execute various types of processes, are stored in advance. The memory 82 is also a storage portion from or to which various types of data D1, D2 can be read or written by the MPU 81. It is noted that a memory in which the control programs Pr1, Pr2, Pr3 are stored and a memory to which the data D1, D2 are recorded may be provided individually.

The signal interface 83 is an interface circuit for relaying signals from the MPU 81 to sensors and control-target devices and vice versa. Via the signal interface 83, the MPU 81 inputs detection signals (measurement signals) from various types of sensors including the developer amount sensor 800.

In addition, via the signal interface 83, the MPU 81 outputs control signals to the drive circuit 84 so as to control the development drive portion 14, the replenishment drive portion 15, the charging device 42, the electricity removing device 46 and the like. The drive circuit 84 causes the control-target devices, such as the development drive portion 14 and the replenishment drive portion 15, to operate or stop based on the control signals from the MPU 81.

Meanwhile, in the developing device 43, the developer replenishment portion 11 may operate while the development process is executed, and the intermediate lateral conveyance portion 121 may stop in the state where the developer remains in the lateral conveyance path 120. In that case, a developer aggregation or a charging failure may occur in the lateral conveyance path 120, which may lead to a developer clog in the conveyance path and a development failure.

However, according to the present embodiment, the control portion 8 is configured to execute a post-development processing control step that is described below, in the case where the developer sent out from the outlet 1101 of the developer replenishment portion 11 is conveyed toward the inlet 1300 of the developing portion 13 along the lateral conveyance path 120 extending in the lateral direction. This makes it possible to prevent the developer from remaining in the lateral conveyance path 120.

Figure 3:
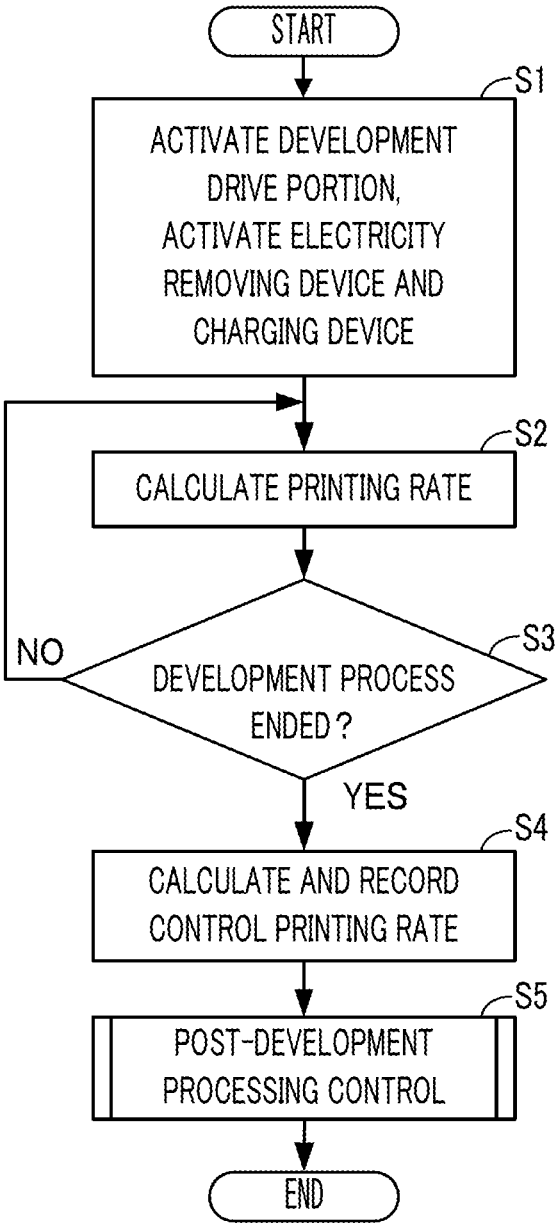
FIG. 3 is a flowchart showing an example of a development execution control step executed by the developing device according to the first embodiment of the present disclosure.
Figure 4:
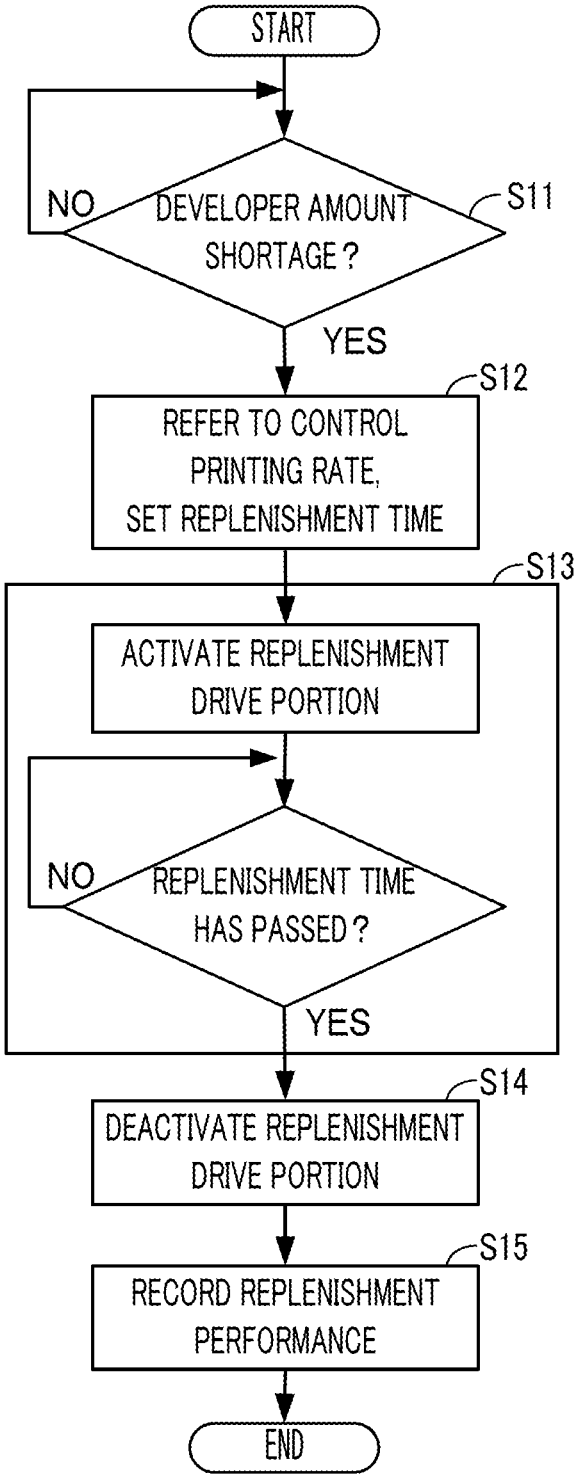
FIG. 4 is a flowchart showing an example of a developer replenishment control step executed by the developing device according to the first embodiment of the present disclosure.
Figure 5:
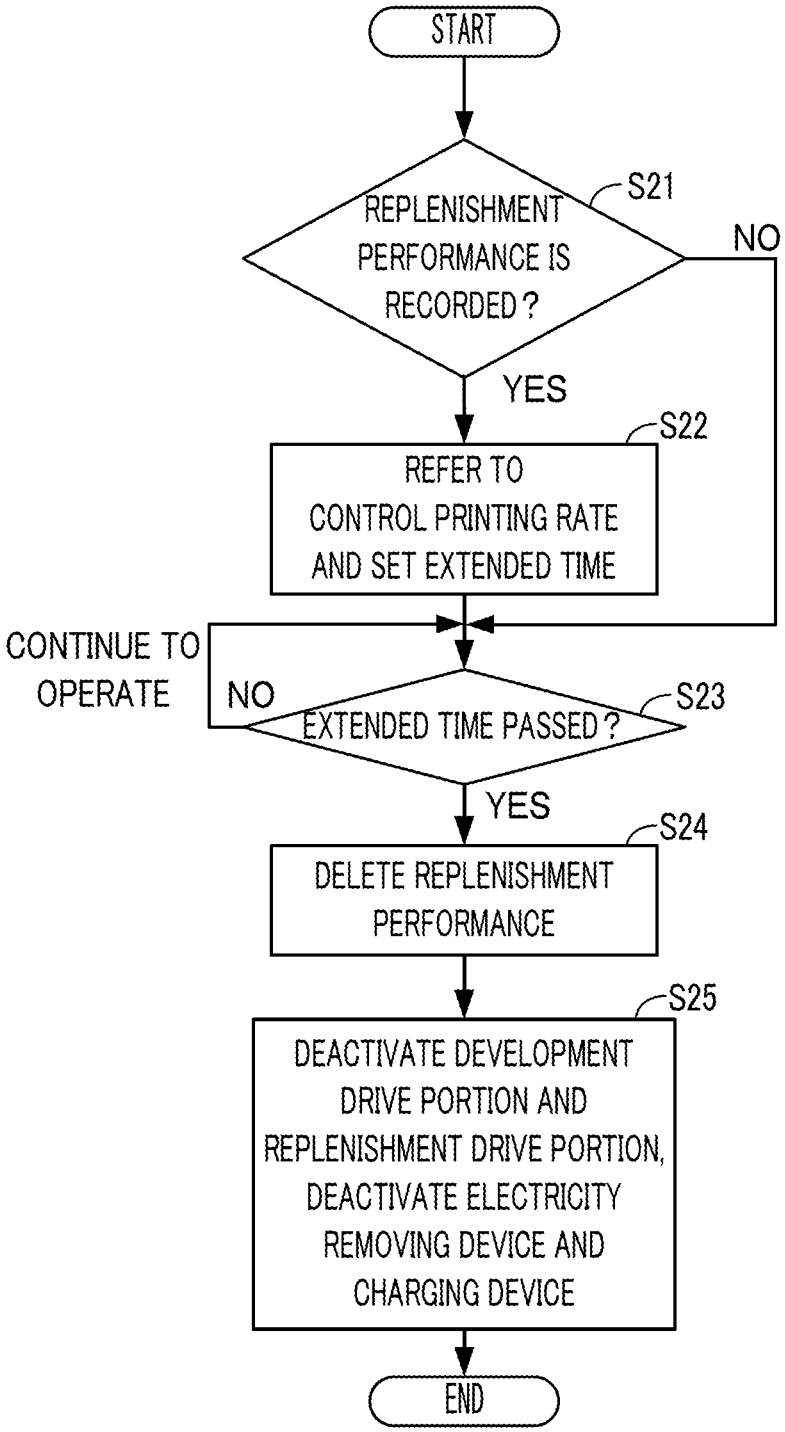
FIG. 5 is a flowchart showing an example of a post-development processing control step executed by the developing device according to the first embodiment of the present disclosure.

The following describes a control example of the developing device 43 with reference to flowcharts shown in FIGS. 3-5. In the following description, S1, S2, . . . represent identification signs of the processing procedures. It is noted that the processes of the control portion 8 described in the following are realized when the MPU 81 executes the control programs stored in the memory 82.

[Development Execution Control Step]

First, an example of the development execution control step is described with reference to FIG. 3. FIG. 3 is a flowchart showing an example of the development execution control step executed by the control portion 8. The control portion 8 executes the development execution control step shown in FIG. 3 when an image forming job occurs.

<Step S1>

When an image forming job occurs, the control portion 8 activates the development drive portion 14, and activates the electricity removing device 46 and the charging device 42. This allows the intermediate lateral conveyance portion 121, the developing portion 13 and the photoconductor 41 to be activated, and the development process corresponding to the image forming job is started.

<Steps S2, S3>

The control portion 8 then calculates the printing rate for each predetermined unit in the development process, and temporarily stores the calculation result (S2). For example, the control portion 8 calculates the printing rate for each image formation on a recording sheet 9. Here, the printing rate is an area ratio of an actually developed part occupying in the area of the image formation range. The control portion 8 repeatedly calculates the printing rate for each predetermined unit until the development process corresponding to the image forming job ends (S3).

<Step S4>

After the development process corresponding to the image forming job ends, the control portion 8 calculates a control printing rate D1 from the printing rates calculated in the step S2. The control portion 8 then records the calculated control printing rate D1 to the memory 82.

The control printing rate D1 is a representative value of the printing rates calculated for each unit area in the development process corresponding to the image forming job. For example, the control printing rate D1 is an average value or an integrated value of the plurality of printing rates calculated in the step S2.

The above-described steps S1-S4 are an example of the development execution control step in which the development process is executed by operating the intermediate lateral conveyance portion 121 and the developing portion 13. The development execution control step is realized when the MPU 81 executes a development execution control program Pr1. The MPU 81 that executes the development execution control program Pr1 is an example of the development execution control portion.

<Step S5>

After the development process corresponding to the image forming job ends, the control portion 8 executes a post-development processing control step that is described below. It is noted that in the post-development processing control step, the control portion 8 causes the intermediate lateral conveyance portion 121 and the developing portion 13 to stop.

[Developer Replenishment Control Step]

Next, an example of a developer replenishment control step is described with reference to FIG. 4. FIG. 4 is a flowchart showing an example of the developer replenishment control step executed by the control portion 8. The control portion 8 executes the developer replenishment control step shown in FIG. 4, for example, when an image forming job occurs. In that case, the development execution control step (S1-S4) and the developer replenishment control step are executed in parallel.

<Step S11>

In the developer replenishment control step, the control portion 8 performs, as necessary, determination on whether or not the detection result of the developer amount sensor 800 satisfies a predetermined shortage condition.

The shortage condition is that, for example, the developer amount sensor 800 detects that the developer amount is smaller than a predetermined proper lower limit amount. The shortage condition is satisfied in the state where the amount of developer in the developing tank 130 has reached a minimum amount necessary for performing a proper development.

It is noted that the shortage condition may be that a state continues for a predetermined period in which the developer amount sensor 800 detects that the developer amount is smaller than the predetermined proper lower limit amount.

<Step S12>

When the detection result of the developer amount sensor 800 satisfies the shortage condition, the control portion 8 refers to the control printing rate D1 recorded in the memory 82. Furthermore, the control portion 8 sets a replenishment time based on the control printing rate D1.

In the step S12, the control portion 8 sets a longer replenishment time as the control printing rate is higher. For example, the control portion 8 sets a replenishment time that has a positive linear correlation with the control printing rate D1.

<Step S13>

Subsequently, the control portion 8 activates the replenishment drive portion 15 and causes it to operate until the replenishment time passes. This allows the developer replenishment portion 11 to operate continuously from the time when the shortage condition is satisfied until the replenishment time passes.

<Steps S14, S15>

When the replenishment time passes, the control portion 8 causes the replenishment drive portion 15 to stop (S14), and records replenishment performance data D2 to the memory 82 (S15). With this step, the developer replenishment control step is completed. The replenishment performance data D2 is data that is referenced to determine whether or not the control portion 8 caused the developer replenishment portion 11 to operate during the development process.

The above-described steps S11-S15 are an example of the developer replenishment control step. The developer replenishment control step is realized when the MPU 81 executes a developer replenishment control program Pr2. The MPU 81 that executes the developer replenishment control program Pr2 is an example of the developer replenishment control portion.

In the developer replenishment control step, the control portion 8 (the developer replenishment control portion) causes the developer replenishment portion 11 to operate when the detection result of the developer amount sensor 800 satisfies the shortage condition (S11, S12).

In the developer replenishment control step, the control portion 8 (the developer replenishment control portion) causes the developer replenishment portion 11 to operate for a longer period as the control printing rate is higher, wherein the control printing rate represents the size of the printing rate (S12, S13). In this case, the operation speed of the developer replenishment portion 11 (the developer delivering portion 111) is constant.

That is, the control portion 8 (the developer replenishment control portion) causes the developer replenishment portion 11 to operate under an operation condition where the higher the printing rate in the development process is, the larger the amount of delivered developer is (S12, S13). This makes it possible to maintain the amount of the developer in the developing tank 130 in a proper range stably even in the case where the detection accuracy of the developer amount sensor 800 is not so high.

[Post-Development Processing Control Step]

Next, an example of the post-development processing control step is described with reference to FIG. 5. FIG. 5 is a flowchart showing an example of the post-development processing control step executed by the control portion 8. The post-development processing control step is executed following the development execution control step (S1-S4).

<Step S21>

In the post-development processing control step, first, the control portion 8 determines whether or not the replenishment performance data D2 is recorded in the memory 82. Upon determining that the replenishment performance data D2 is recorded in the memory 82, the control portion 8 moves the process to step S22, and upon determining that the replenishment performance data D2 is not recorded in the memory 82, the control portion 8 moves the process to step S25.

The fact that the replenishment performance data D2 is recorded in the memory 82 indicates that the control portion 8 caused the developer replenishment portion 11 to operate during the development process. On the other hand, the fact that the replenishment performance data D2 is not recorded in the memory 82 indicates that the developer replenishment portion 11 did not operate during the development process.

<Step S22>

Upon determining that the replenishment performance data D2 is recorded in the memory 82, the control portion 8 refers to the control printing rate D1 recorded in the memory 82. The control portion 8 further sets an extended time based on the control printing rate D1.

In the step S22, the control portion 8 sets a longer extended time as the control printing rate is higher. For example, the control portion 8 sets an extended time that has a positive linear correlation with the control printing rate D1.

<Step S23>

The control portion 8 causes the development drive portion 14, the electricity removing device 46 and the charging device 42 to operate continuously from and after the development execution control step until the extended time passes.

<Step S24>

Upon determining that the extended time has passed, the control portion 8 deletes the replenishment performance data D2 from the memory 82.

<Step S25>

Furthermore, upon determining that the extended time has passed (YES at S23), the control portion 8 causes the development drive portion 14, the electricity removing device 46 and the charging device 42 to stop. This allows the intermediate lateral conveyance portion 121, the developing portion 13 and the photoconductor 41 to stop operating, and the post-development processing control step (S5, S21-S25) ends. Upon determining that the replenishment performance data D2 is not recorded in the memory 82 (NO at S21), the control portion 8 immediately causes the development drive portion 14, the electricity removing device 46 and the charging device 42 to stop without waiting for the extended time to pass.

The above-described steps S21-S25 (S5) are an example of the post-development processing control step. The post-development processing control step is realized when the MPU 81 executes a post-development processing control program Pr3. The MPU 81 that executes the post-development processing control program Pr3 is an example of the post-development processing control portion.

In the post-development processing control step, the control portion 8 (the post-development processing control portion) causes the intermediate lateral conveyance portion 121 and the developing portion 13 to operate continuously from and after the development process and then stop (S23, S25). With this configuration, it is possible to prevent the developer from remaining in the lateral conveyance path 120. As a result, it is possible to prevent the occurrence of inconveniences such as the developer aggregation and the charging failure, and further prevent the occurrence of a developer clog in the conveyance path and a development failure which would be caused by the inconveniences.

In addition, the control portion 8 (the post-development processing control portion) causes the intermediate lateral conveyance portion 121 and the developing portion 13 to operate for a longer period after the development process as the control printing rate is higher, wherein the control printing rate represents the size of the printing rate (S22, S23, S25). In this case, the operation speed of the developer replenishment portion 11 (the developer delivering portion 111) is constant.

That is, the control portion 8 (the post-development processing control portion) causes the intermediate lateral conveyance portion 121 to operate under an operation condition where the higher the printing rate in the development process is, the larger the amount of developer delivered after the development process is. With this configuration, when the amount of developer delivered from the developer replenishment portion 11 is controlled based on the printing rate, the operation of the intermediate lateral conveyance portion 121 and the developing portion 13 is extended without excess or deficiency (S23).

Furthermore, it is only when the developer replenishment portion 11 operates in the developer replenishment control step during the development process that the control portion 8 (the post-development processing control portion) causes the intermediate lateral conveyance portion 121 and the developing portion 13 to operate continuously from and after the development process and then stop (S21, S23, S25). With this configuration, it is possible to prevent the deterioration of the developer and wasteful power consumption that would occur if the operation of the intermediate lateral conveyance portion 121 and the developing portion 13 is unnecessarily extended (S23).

In addition, in the present embodiment, the amount of developer delivered by the developer replenishment portion 11 and the intermediate lateral conveyance portion 121 is controlled by the operation time, not by the operation speed. With this configuration, the amount of delivered developer can be adjusted by the development drive portion 14 and the replenishment drive portion 15 that have simple configuration.

Meanwhile, in the developing device 43, in order to stabilize the development quality, the developer replenishment process of replenishing the developer from the replenishment container 110 to the developing tank 130 is desirably always started in a predetermined initial state where there is no developer remaining in the lateral conveyance path 120.

On the other hand, in the developing device 43, the developer replenishment portion 11 may operate during the development process, and the intermediate lateral conveyance portion 121 may stop in the state where some developer remains in the lateral conveyance path 120.

For example, in the developing device 43, when the development process of developing the electrostatic latent image on the photoconductor 41 and the developer replenishment process are executed in parallel, the processes may be suspended halfway due to some reason. The reason for the suspension may be an occurrence of an error such as a paper jam of the recording sheet 9, a performance of a forcibly stop operation such as a power OFF or the like.

When the development process and the developer replenishment process are suspended halfway, the intermediate lateral conveyance portion 121 stops in the state where the developer remains in the lateral conveyance path 120. This means that the development process and the developer replenishment process resume from the suspension in the state where the developer remains in the lateral conveyance path 120. This is not preferable for the stabilization of the developer quality.

However, the control portion 8 can execute a development resumption pre-processing control step that is described below, when the developer sent out from the outlet 1101 of the developer replenishment portion 11 is conveyed toward the inlet 1300 of the developing portion 13 along the lateral conveyance path 120 that extends in the lateral direction. With this configuration, the development process and the developer replenishment process can resume from a suspension in an initial state where there is no remnant developer in the lateral conveyance path 120.

In addition, even when the development process and the developer replenishment process are completed, a long time may pass in the state where there is remnant developer in the lateral conveyance path 120. In that case, a developer aggregation or a charging failure may occur in the lateral conveyance path 120, which may lead to a developer clog in the conveyance path and a development failure.

However, the control portion 8 can execute a post-development processing control step that is described below, when the developer sent out from the outlet 1101 of the developer replenishment portion 11 is conveyed toward the inlet 1300 of the developing portion 13 along the lateral conveyance path 120 that extends in the lateral direction. With this configuration, it is possible to prevent the developer from remaining in the lateral conveyance path 120. In a developing device 43A according to the second embodiment, the control portion 8 executes a development resumption pre-processing control step that is described below.

[Second Embodiment]

Figure 6:
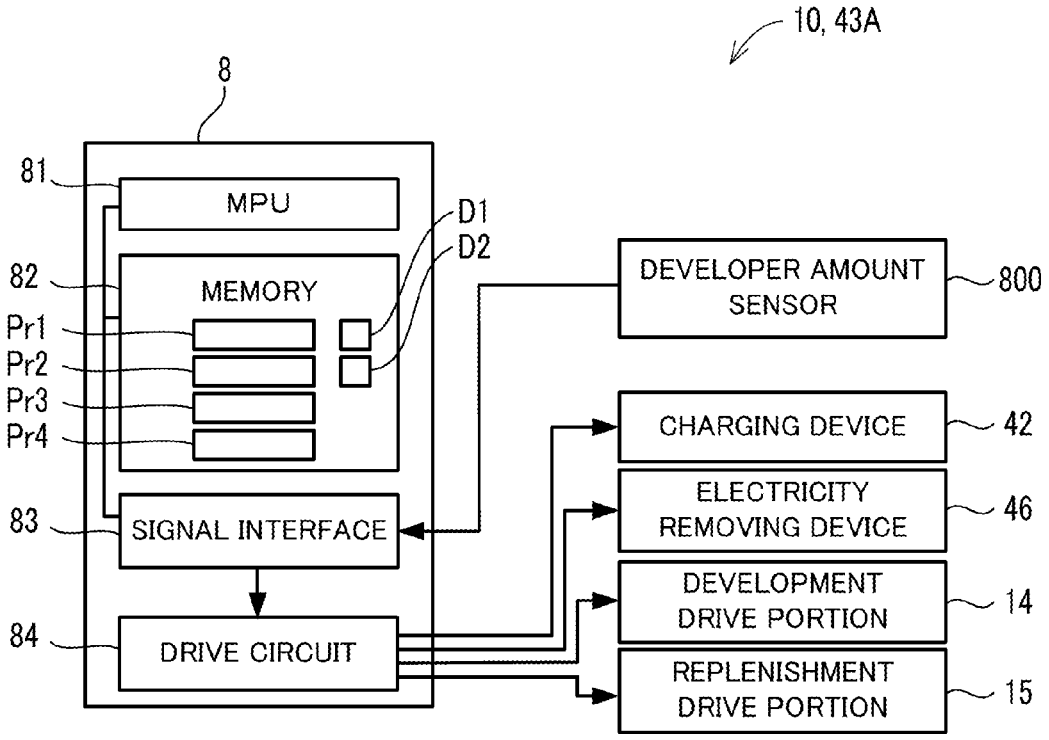
FIG. 6 is a block diagram of control-related equipment of the developing device according to the second embodiment of the present disclosure.

Next, the developing device 43A according to the second embodiment is described with reference to FIGS. 6-10. In FIG. 6, the components that are the same as those shown in FIGS. 1 and 2 are assigned the same reference signs.

The developing device 43A has the same configuration as the developing device 43. As shown in FIG. 6, the developing device 43A differs from the developing device 43 in the programs executed by the MPU 81. In the following, the difference of the developing device 43A from the developing device 43 is described.

In the developing device 43A, the control portion 8 controls the replenishment drive portion 15 based on the detection result of the developer amount sensor 800, and controls the development drive portion 14 based on the state of the image forming job. In the present embodiment, at least a portion of the control portion 8 that controls the development drive portion 14 and the replenishment drive portion 15 forms a part of the developing device 43A.

In the developing device 43A, the control portion 8 comprehensively controls the image forming apparatus 10 when the MPU 81 executes various types of control programs Pr11-Pr14 stored in advance in the memory 82.

In the developing device 43A, the memory 82 is a nonvolatile storage portion in which various types of information such as the control programs Pr11-Pr14 that cause the MPU 81 to execute various types of processes, are stored in advance.

Figure 7:
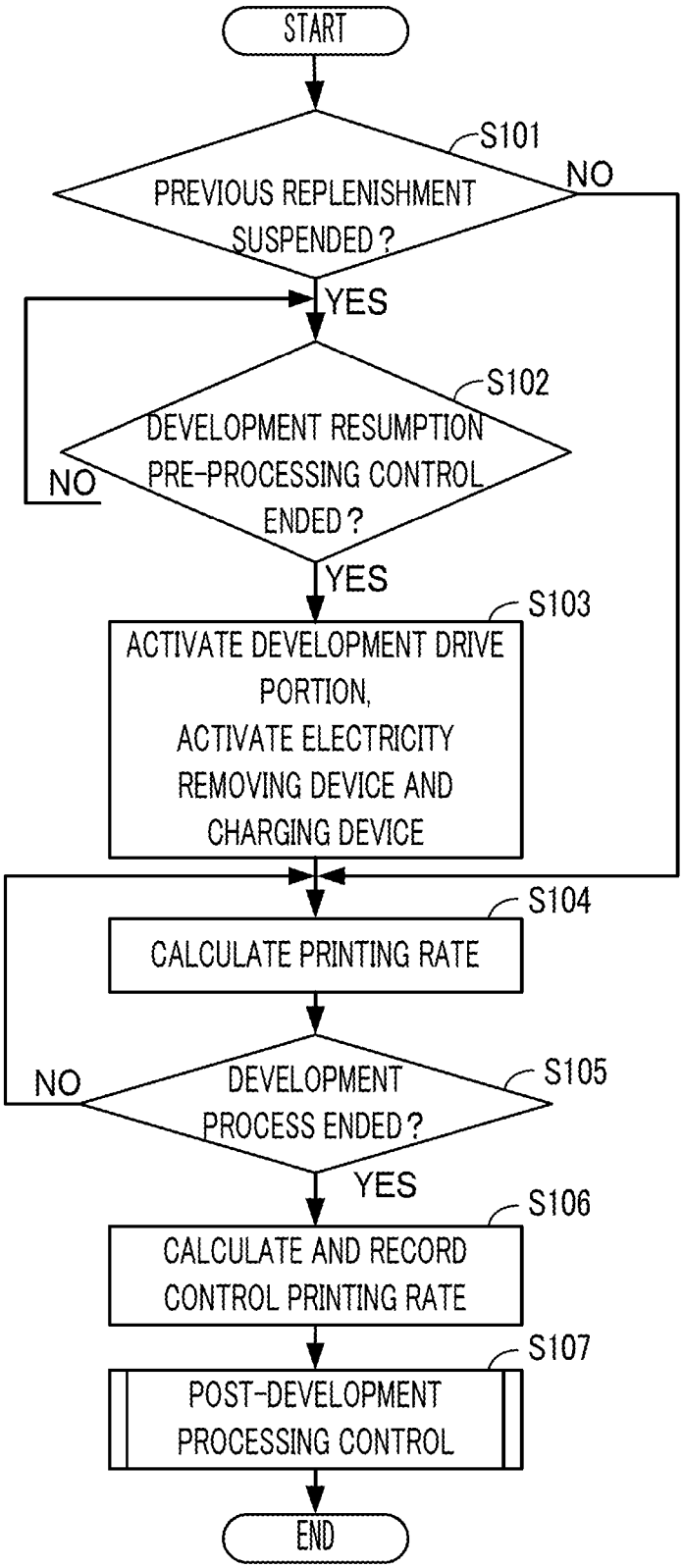
FIG. 7 is a flowchart showing an example of the development execution control step executed by the developing device according to the second embodiment of the present disclosure.
Figure 8:
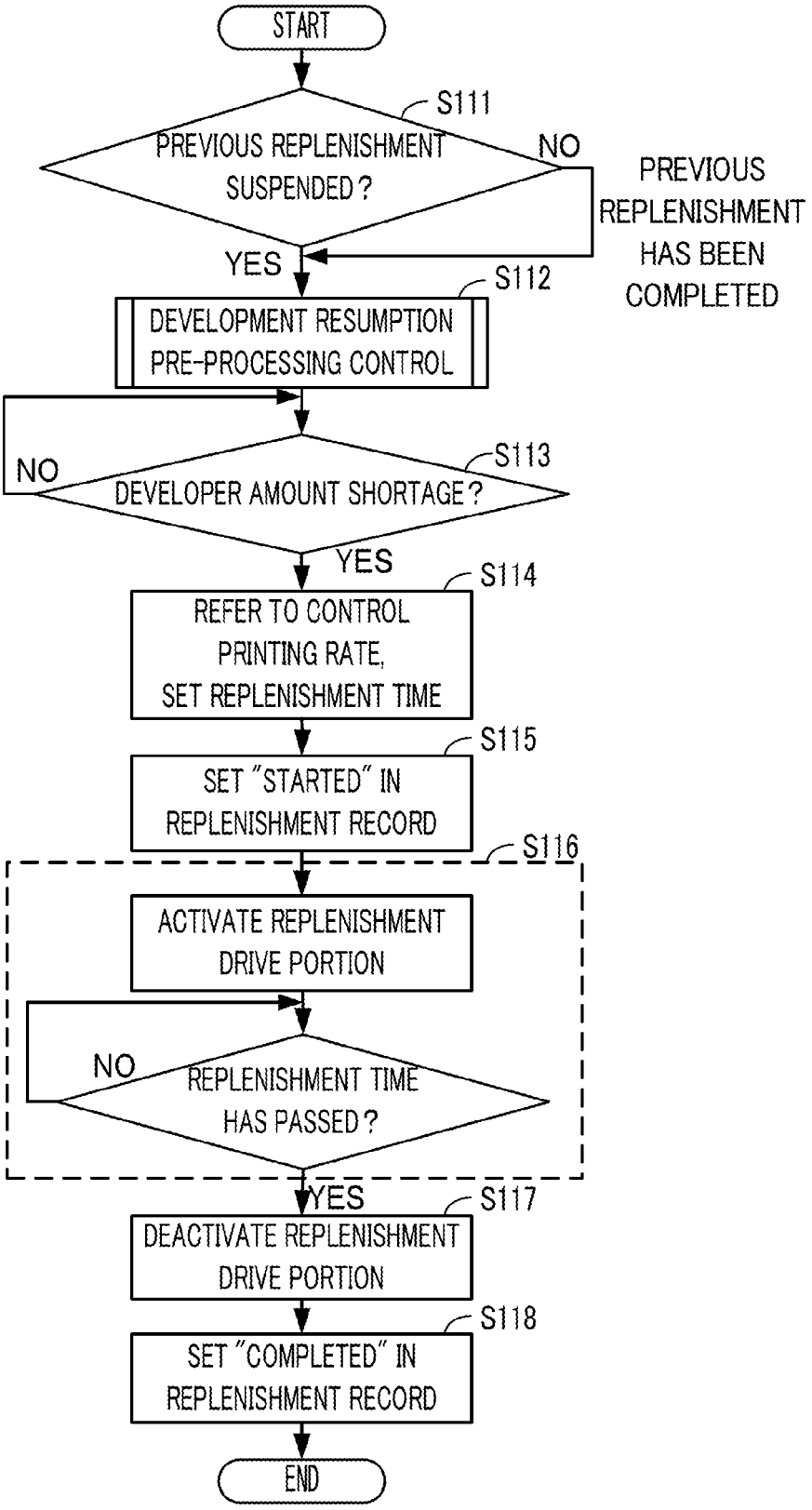
FIG. 8 is a flowchart showing an example of the developer replenishment control step executed by the developing device according to the second embodiment of the present disclosure.
Figure 9:
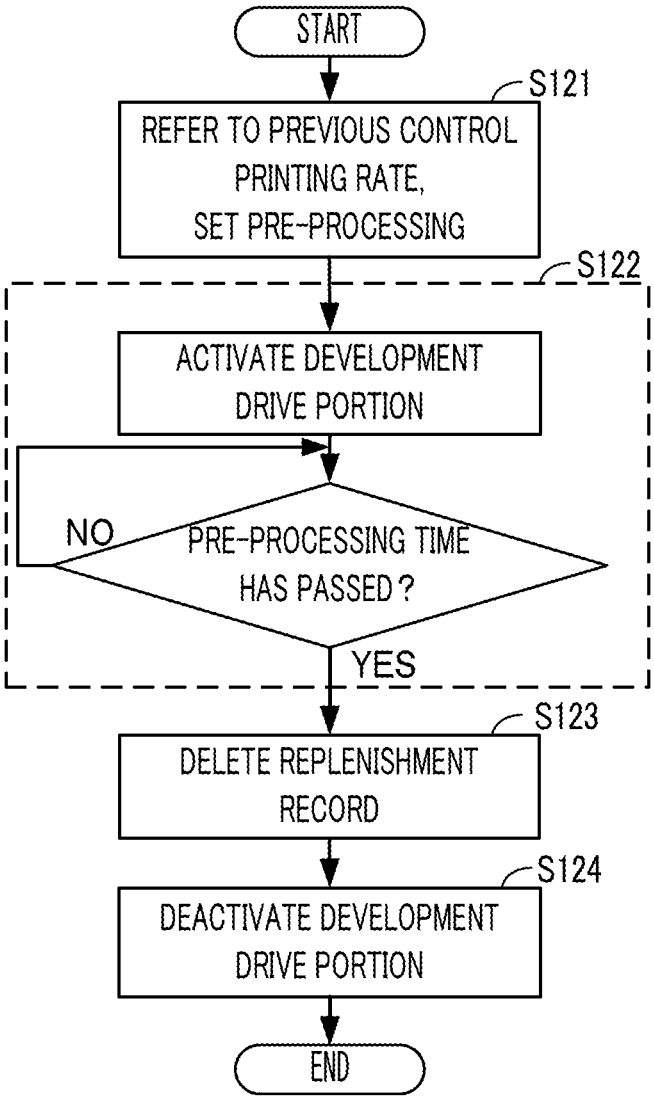
FIG. 9 is a flowchart showing an example of a development resumption pre-processing control step executed by the developing device according to the second embodiment of the present disclosure.

The following describes a control example of the developing device 43A with reference to flowcharts shown in FIGS. 7-9. In the following description, S101, S102, . . . represent identification signs of the processing procedures. It is noted that the processes of the control portion 8 described in the following are realized when the MPU 81 executes the control programs stored in the memory 82.

[Development Execution Control Step]

First, an example of the development execution control step is described with reference to FIG. 7. FIG. 7 is a flowchart showing an example of the development execution control step executed by the control portion 8. The control portion 8 executes the development execution control step shown in FIG. 7 when an image forming job occurs, or when processing of the image forming job resumes after suspension.

<Step S101>

In the development execution control step of the developing device 43A, first, the control portion 8 determines whether or not currently the developing device 43A is in a state where the previous development execution control step has been suspended halfway and thereby the previous developer replenishment process has been suspended halfway. That is, the control portion 8 determines whether or not currently the developing device 43A is in a state where the development process is to resume from a suspension of the development process and the developer replenishment process.

In step S101, the control portion 8 determines whether or not the previous developer replenishment process has been suspended halfway, by referring to replenishment performance data recorded in the memory 82. The replenishment performance data is described below.

Upon determining that the previous developer replenishment process was not suspended halfway, the control portion 8 skips the next step S102, and moves the process to step S103 that is described below.

<Step S102>

Upon determining that the previous developer replenishment process has been suspended halfway, the control portion 8 waits until a development resumption pre-processing control step that is described below ends, and then moves the process to step S103 that is described below.

<Step S103>

In step S103, the control portion 8 activates the development drive portion 14, the electricity removing device 46, and the charging device 42. At this time, the control portion 8 also executes the process of writing the electrostatic latent image onto the photoconductor 41 by controlling the optical scanning portion 5. This allows the circulating conveyance portion 132, the developing roller 131 and the photoconductor 41 to be activated, and the development process corresponding to the image forming job is started. It is noted that in the present embodiment, when the circulating conveyance portion 132 operates, the intermediate lateral conveyance portion 121 operates in conjunction with it.

<Steps S104, S105>

The control portion 8 then calculates the printing rate for each predetermined unit in the development process, and temporarily stores the calculation result (S104). For example, the control portion 8 calculates the printing rate for each image formation on a recording sheet 9. Here, the printing rate is an area ratio of an actually developed part occupying in the area of the image formation range. The control portion 8 repeatedly calculates the printing rate for each predetermined unit until the development process corresponding to the image forming job ends (S105).

<Step S106>

After the development process corresponding to the image forming job ends, the control portion 8 calculates the control printing rate D1 from the printing rates calculated in the step S104. The control portion 8 then records the calculated control printing rate D1 to the memory 82.

The control printing rate D1 is a representative value of printing rates calculated for each unit area in the development process corresponding to the image forming job. For example, the control printing rate D1 is an average value or an integrated value of the plurality of printing rates calculated in the step S104.

The above-described steps S101-S106 are an example of the development execution control step in which the development process of developing the electrostatic latent image on the photoconductor 41 (image carrier) is executed by causing the circulating conveyance portion 132 and the developing roller 131 to operate. The development execution control step is realized when the MPU 81 executes the development execution control program Pr1. The MPU 81 that executes the development execution control program Pr1 is an example of the development execution control portion.

<Step S107>

After the development process corresponding to the image forming job ends, the control portion 8 executes the post-development processing control step that is described below. It is noted that in the post-development processing control step, the control portion 8 causes the development drive portion 14 to stop.

[Developer Replenishment Control Step]

Next, an example of the developer replenishment control step is described with reference to FIG. 8. FIG. 8 is a flowchart showing an example of the developer replenishment control step executed by the control portion 8. The control portion 8 executes the developer replenishment control step shown in FIG. 8, for example, when an image forming job occurs or when processing of the image forming job resumes from a suspension. In this case, the development execution control step (S101-S106) and the developer replenishment control step are executed in parallel.

<Step S111>

In the developer replenishment control step, the control portion 8 determines, as in the step S101, whether or not currently the developing device 43A is in a state where the previous developer replenishment process has been suspended halfway. That is, the control portion 8 determines whether or not currently the developing device 43A is in a state where the development process and the developer replenishment process resume from a suspension.

Upon determining that the previous developer replenishment process was not suspended halfway, the control portion 8 skips the next step S112, and moves the process to step S113 that is described below.

<Step S112>

Upon determining that the previous developer replenishment process has been suspended halfway, the control portion 8 executes the development resumption pre-processing control step that is described below, and then moves the process to step S113 that is described below.

<Step S113>

In the step S113, the control portion 8 performs, as necessary, a determination on whether or not the detection result of the developer amount sensor 800 satisfies a predetermined shortage condition.

The shortage condition is that, for example, the developer amount sensor 800 detects that the developer amount is smaller than a predetermined proper lower limit amount. The shortage condition is satisfied in the state where the amount of developer in the developing tank 130 has reached a minimum amount necessary for performing a proper development.

It is noted that the shortage condition may be that a state continues for a predetermined period in which the developer amount sensor 800 detects that the developer amount is smaller than the predetermined proper lower limit amount.

<Step S114>

When the detection result of the developer amount sensor 800 satisfies the shortage condition, the control portion 8 refers to the control printing rate D1 recorded in the memory 82. Furthermore, the control portion 8 sets a replenishment time based on the control printing rate D1.

In the step S114, the control portion 8 sets a longer replenishment time as the control printing rate is higher. For example, the control portion 8 sets a replenishment time that has a positive linear correlation with the control printing rate D1.

<Step S115>

The control portion 8 further records replenishment performance data D2 to the memory 82, wherein the replenishment performance data D2 here is set to "started" indicating that the developer replenishment process has been started. As described below, the replenishment performance data D2 is data that indicates whether the developer replenishment process has been completed or suspended halfway.

<Step S116>

The control portion 8 further activates the replenishment drive portion 15 and causes it to operate until the replenishment time passes. This allows the developer replenishment portion 11 to operate continuously from the time when the shortage condition is satisfied until the replenishment time passes. The step S116 is executed in parallel to the steps S103-S105 in the development execution control step. As a result, in the step S116, the control portion 8 causes the intermediate lateral conveyance portion 121, the circulating conveyance portion 132, and the developing roller 131 to operate, as well as the developer replenishment portion 11.

<Steps S117, S118>

When the replenishment time passes, the control portion 8 causes the replenishment drive portion 15 to stop (S117), and records (updates) the replenishment performance data D2 to the memory 82, wherein the replenishment performance data D2 here is set to "completed" indicating that the developer replenishment process has been completed. With this step, the developer replenishment control step ends.

When the replenishment performance data D2 has been set to "completed" at the start of the development process, it indicates that the developer replenishment process was executed during the previous development process, and the developer replenishment process was completed. On the other hand, when the replenishment performance data D2 has been set to "started" at the start of the development process, it indicates that the developer replenishment process was executed during the previous development process, and the developer replenishment process has been suspended.

As a result, in the above-described steps S101, S111, the control portion 8 determines whether or not the previous developer replenishment process has been suspended, by referring to the replenishment performance data D2.

The above-described steps S113-S118 are an example of the developer replenishment control step. The developer replenishment control step is realized when the MPU 81 executes the developer replenishment control program Pr2.

The MPU 81 that executes the developer replenishment control program Pr2 is an example of the developer replenishment control portion.

In the developer replenishment control step, the control portion 8 (the developer replenishment control portion) causes the developer replenishment portion 11 to operate when the detection result of the developer amount sensor 800 satisfies the shortage condition (S113, S114).

In the developer replenishment control step, the control portion 8 (the developer replenishment control portion) causes the developer replenishment portion 11 and the intermediate lateral conveyance portion 121 to operate for a longer period as the control printing rate is higher, wherein the control printing rate represents the size of the printing rate (S114, S116). In this case, the operation speed of the developer replenishment portion 11 (the developer delivering portion 111) is constant.

That is, the control portion 8 (the developer replenishment control portion) causes the developer replenishment portion 11 to operate under an operation condition where the higher the printing rate in the development process is, the larger the amount of delivered developer is (S114, S116). This makes it possible to maintain the amount of the developer in the developing tank 130 in a proper range stably even in the case where the detection accuracy of the developer amount sensor 800 is not so high.

[Post-Development Processing Control Step]

In the developing device 43A, too, the control portion 8 executes, in step S107, the post-development processing control step shown in FIG. 5. Here, the description of the post-development processing control step in the developing device 43A is omitted. The post-development processing control step is executed following the development execution control step (S101-S106).

[Development Resumption Pre-Processing Control Step]

Next, an example of the development resumption pre-processing control step (S112) is described with reference to FIG. 9. FIG. 9 is a flowchart showing an example of the development resumption pre-processing control step executed by the control portion 8. The development resumption pre-processing control step is executed before the development process and the developer replenishment process resume from a suspension (S112).

<Step S121>

In the development resumption pre-processing control step, the control portion 8 refers to the control printing rate D1 recorded in the memory 82. At this time, the control printing rate D1 recorded in the memory 82 represents the printing rate in the previous development process that has been suspended. The control portion 8 further sets a pre-processing time based on the control printing rate D1.

In the step S121, the control portion 8 sets a longer pre-processing time as the control printing rate is higher. For example, the control portion 8 sets a pre-processing time that has a positive linear correlation with the control printing rate D1.

<Step S122>

Subsequently, the control portion 8 activates the development drive portion 14 and causes it to operate until the pre-processing time passes. This allows the intermediate lateral conveyance portion 121 and the circulating conveyance portion 132 to operate. As a result, the developer that remains in the lateral conveyance path 120 is conveyed into the developing tank 130, and is stirred in the developing tank 130.

In step S122, the control portion 8 does not execute the process of writing the electrostatic latent image onto the photoconductor 41. In addition, in the step S122, the control portion 8 does not cause the replenishment drive portion 15 to operate. As a result, the step S122 is executed before the development process and the developer replenishment process are executed.

It is noted that in the present embodiment, in the step S122, the photoconductor 41 is rotated such that the cleaning device 47 removes the remnant developer from the photoconductor 41. Furthermore, in the present embodiment, the developing roller 131 is rotated in the step S122, but the development process is not executed since the electrostatic latent image is not written.

<Step S123>

When the pre-processing time passes, the control portion 8 deletes the replenishment performance data D2 from the memory 82.

<Step S124>

In addition, when the pre-processing time passes, the control portion 8 causes the development drive portion 14 to stop. This allows the intermediate lateral conveyance portion 121 and the circulating conveyance portion 132 to stop, and the development resumption pre-processing control step (S112, S121-S124) ends. It is noted that the photoconductor 41 and the developing roller 131 stop as well.

The above-described steps S121-S124 are an example of the development resumption pre-processing control step. The development resumption pre-processing control step is realized when the MPU 81 executes a development resumption pre-processing control program Pr14. The MPU 81 that executes the development resumption pre-processing control program Pr14 is an example of the development resumption pre-processing control portion.

In the development resumption pre-processing control step, the control portion 8 causes the intermediate lateral conveyance portion 121 and the developing roller 131 to operate before the development process and the developer replenishment process resume from a suspension (S122). With this configuration, even when the development process and the developer replenishment process are suspended halfway, it is possible to resume the development process and the developer replenishment process in the initial state where there is no remnant developer the lateral conveyance path 120. This allows the development quality to be stabilized.

In addition, the control portion 8 causes the intermediate lateral conveyance portion 121 to operate under an operation condition where the higher the printing rate (the control printing rate D1) in the previous development process that has been suspended is, the larger the amount of delivered developer is (S121, S122).

More specifically, the control portion 8 causes the intermediate lateral conveyance portion 121 and the circulating conveyance portion 132 to operate for a longer period before the development process and the developer replenishment process resume from a suspension, as the printing rate in the previous development process that has been suspended is higher (S121, S122). In this case, the operation speed of the intermediate lateral conveyance portion 121 and the circulating conveyance portion 132 is constant.

In the case where the amount of developer delivered from the developer replenishment portion 11 is controlled based on the printing rate, the pre-processing time is set based on the printing rate. With this configuration, the intermediate lateral conveyance portion 121 and the circulating conveyance portion 132 are caused to operate without excess or deficiency in the development resumption pre-processing control step (S122). As a result, it is possible to prevent the deterioration of the developer and wasteful power consumption that would occur due to unnecessary operation of the intermediate lateral conveyance portion 121 and the circulating conveyance portion 132.

In addition, in the present embodiment, the amount of developer delivered by the developer replenishment portion 11 (the developer delivering portion 111), the intermediate lateral conveyance portion 121 and the circulating conveyance portion 132 is controlled by the operation time, not by the operation speed. With this configuration, the amount of delivered developer can be adjusted by the development drive portion 14 and the replenishment drive portion 15 that have simple configuration.

[Other Application Examples]

The amount of developer delivered by the developer replenishment portion 11 and the intermediate lateral conveyance portion 121 that is adjusted based on the printing rate may be adjusted by changing the operation speed of the developer replenishment portion 11 and the developer intermediate conveyance portion 12.

In the developer replenishment control step (S11-S15, S113-S117), the control portion 8 may record the operation time of the developer replenishment portion 11 into the memory 82. Subsequently, in the post-development processing control step, the control portion 8 may set the extended time that corresponds to the recorded operation time. Similarly, in the step S121, the control portion 8 may set the pre-processing time that corresponds to the recorded operation time.

The developing device 43A may include, individually, an intermediate conveyance drive portion and a development drive portion, wherein the intermediate conveyance drive portion drives the intermediate lateral conveyance portion 121, and the development drive portion drives the photoconductor 41, the developing roller 131, and the circulating conveyance portion 132. In this case, the control portion 8 causes the development drive portion to operate in the step S103, and causes the development drive portion to stop in the step S125. In addition, the control portion 8 causes the replenishment drive portion 15 and the intermediate conveyance drive portion in the step S116, and causes the replenishment drive portion 15 and the intermediate conveyance drive portion to stop in the step S117. Furthermore, the control portion 8 causes the intermediate conveyance drive portion and the development drive portion in the step S132, and causes the intermediate conveyance drive portion and the development drive portion to stop in the step S134.

In addition, the developing device 43A may individually include an intermediate conveyance drive portion for driving the intermediate lateral conveyance portion 121, a circulating conveyance drive portion for driving the circulating conveyance portion 132, and a development drive portion for driving the photoconductor 41 and the developing roller 131. In this case, the control portion 8 causes the circulating conveyance drive portion and the development drive portion to operate in the step S103, and causes the circulating conveyance drive portion and the development drive portion to stop in the step S125. In addition, the control portion 8 causes the replenishment drive portion 15 and the intermediate conveyance drive portion in the step S116, and causes the replenishment drive portion 15 and the intermediate conveyance drive portion to stop in the step S117. Furthermore, the control portion 8 causes the intermediate conveyance drive portion and the circulating conveyance drive portion to operate in the step S132, and causes the intermediate conveyance drive portion and the circulating conveyance drive portion to stop in the step S134.

The image forming apparatus 10 may include an intermediate transfer belt and a belt cleaning device, wherein an image is transferred from the photoconductor 41 to the intermediate transfer belt, and the belt cleaning device removes remnant developer from the intermediate transfer belt. In this case, in the development resumption pre-processing control step, the intermediate transfer belt is rotated and the belt cleaning device removes the remnant developer from the intermediate transfer belt.

It is noted that the developing device and the image forming apparatus of the present disclosure may be configured by, within the scope of claims, freely combining the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer replenishment portion configured to deliver developer from a replenishment container storing the developer;

an intermediate lateral conveyance portion configured to convey the developer delivered from the developer replenishment portion to an outlet of a lateral conveyance path along the lateral conveyance path that extends in a lateral direction;

a developing portion including a circulating conveyance portion and a developing roller, the circulating conveyance portion being configured to cause the developer to circulate in a developing tank storing the developer sent out from the outlet of the lateral conveyance path, the developing roller being configured to supply the developer from the developing tank to an image carrier;

a developer amount sensor configured to detect an amount of the developer in the developing tank;

a development execution control portion configured to execute a development process of developing an electrostatic latent image on the image carrier, by causing the circulating conveyance portion and the developing roller to operate;

a developer replenishment control portion configured to execute a developer replenishment process by causing the developer replenishment portion and the intermediate lateral conveyance portion to operate when a detection result of the developer amount sensor satisfies a predetermined shortage condition while the development process is executed; and a development resumption pre-processing control portion configured to cause the intermediate lateral conveyance portion and the circulating conveyance portion to operate before the development process and the developer replenishment process resume from a suspension; wherein the development resumption pre-processing control portion causes the intermediate lateral conveyance portion to operate under an operation condition where the higher a printing rate in a previous development process that has been suspended is, the larger an amount of delivered developer is;

the development resumption pre-processing control portion causes the developer replenishment portion and the intermediate lateral conveyance portion to operate for a longer period as the printing rate in the development process is higher; and the development resumption pre-processing control portion causes the intermediate lateral conveyance portion and the circulating conveyance portion to operate for a longer period before the development process and the developer replenishment process resume from a suspension, as the printing rate in the previous development process that has been suspended is higher.

2. A developing device comprising:

a developer replenishment portion configured to deliver developer from a replenishment container storing the developer;

an intermediate lateral conveyance portion configured to convey the developer delivered from the developer replenishment portion to an outlet of a lateral conveyance path along the lateral conveyance path that extends in a lateral direction;

a developing portion including a circulating conveyance portion and a developing roller, the circulating conveyance portion being configured to cause the developer to circulate in a developing tank storing the developer sent out from the outlet of the lateral conveyance path, the developing roller being configured to supply the developer from the developing tank to an image carrier;

a developer amount sensor configured to detect an amount of the developer in the developing tank;

a development execution control portion configured to execute a development process of developing an electrostatic latent image on the image carrier, by causing the circulating conveyance portion and the developing roller to operate;

a developer replenishment control portion configured to execute a developer replenishment process by causing the developer replenishment portion and the intermediate lateral conveyance portion to operate when a detection result of the developer amount sensor satisfies a predetermined shortage condition while the development process is executed;

a development resumption pre-processing control portion configured to cause the intermediate lateral conveyance portion and the circulating conveyance portion to operate before the development process and the developer replenishment process resume from a suspension; and a post-development processing control portion configured to cause the intermediate lateral conveyance portion and the circulating conveyance portion to operate continuously from and after the development process and then stop, in a case where the developer replenishment process is executed during the development process.

* * * * *